US006497207B2

(12) United States Patent
Spath et al.

(10) Patent No.: US 6,497,207 B2
(45) Date of Patent: Dec. 24, 2002

(54) DEACTIVATION ROLLER HYDRAULIC VALVE LIFTER

(75) Inventors: Mark J. Spath, Spencerport, NY (US); Albert C. Stone, Grandville, MI (US); Carl R. Kangas, Sand Lake, MI (US); David M. McCarthy, Churchville, NY (US)

(73) Assignee: Delphi Technologies, Inc., Troy, MI (US)

( * ) Notice: Subject to any disclaimer, the term of this patent is extended or adjusted under 35 U.S.C. 154(b) by 8 days.

(21) Appl. No.: 09/840,375

(22) Filed: Apr. 23, 2001

(65) Prior Publication Data

US 2002/0046718 A1 Apr. 25, 2002

Related U.S. Application Data

(63) Continuation-in-part of application No. 09/693,452, filed on Oct. 20, 2000.

(51) Int. Cl.[7] ..... F01L 13/00; F02D 13/06

(52) U.S. Cl. ..... 123/90.16; 123/90.5; 123/90.55; 123/198 F; 74/569

(58) Field of Search ..... 123/90.15, 90.16, 123/90.48, 90.49, 90.5, 90.55, 198 F; 74/569

(56) References Cited

U.S. PATENT DOCUMENTS

| | | | |
|---|---|---|---|
| 5,253,621 | A | 10/1993 | Dopson et al. |
| 5,544,626 | A | 8/1996 | Diggs et al. |
| 5,660,153 | A | 8/1997 | Hampton et al. |

(List continued on next page.)

FOREIGN PATENT DOCUMENTS

DE 19804952 A1 8/1999

OTHER PUBLICATIONS

Buuck, Bryce, et al., "Engine Trends and Valve Train Systems for Improved Performance and Fuel Economy", *Eaton Corporation—Engine Components Operations*, USA, pp. 1–9 (Aug. 1999).

Fortnagel, Manfred, et al., "Four Made of Eight—The New 4.31 and 5.01 V8 Engines", *Mercedes–Benz S–Class*, pp. 58–62, (1997).

(List continued on next page.)

*Primary Examiner*—Weilun Lo
(74) *Attorney, Agent, or Firm*—Patrick M. Griffin

(57) ABSTRACT

A deactivation hydraulic valve lifter includes an elongate lifter body having a substantially cylindrical inner wall. The inner wall defines at least one annular pin chamber therein. The lifter body has a first end configured for engaging a cam of an engine. An elongate pin housing includes a substantially cylindrical pin housing wall and pin housing bottom. The pin housing wall includes an inner surface and an outer surface. The pin housing bottom defines a radially directed pin bore therethrough. The pin housing is concentrically disposed within the inner wall of the lifter body such that the outer surface of the pin housing wall is adjacent to at least a portion of the inner wall of the lifter body. A plunger having a substantially cylindrical plunger wall with an inner surface and an outer surface is concentrically disposed within the pin housing such that the outer surface of the plunger wall is adjacent to at least a portion of the inner surface of the pin housing wall. A deactivation pin assembly is disposed within the pin bore and includes two pin members. The pin members are biased radially outward relative to each other. A portion of each pin member is disposed within the annular pin chamber to thereby couple the lifter body to the pin housing. The pin members are configured for moving toward each other when the pin chamber is pressurized, thereby retracting the pin members from within the annular pin chamber and decoupling the lifter body from the pin housing.

9 Claims, 8 Drawing Sheets

U.S. PATENT DOCUMENTS

| | | | | | |
|---|---|---|---|---|---|
| 5,682,848 | A | | 11/1997 | Hampton et al. | |
| 5,803,040 | A | | 9/1998 | Biesinger et al. | |
| 5,875,748 | A | | 3/1999 | Haas et al. | |
| 6,164,255 | A | * | 12/2000 | Maas et al. | 123/90.16 |
| 6,196,175 | B1 | * | 3/2001 | Church | 123/90.16 |
| 6,247,433 | B1 | * | 6/2001 | Faria et al. | 123/90.16 |
| 6,321,704 | B1 | * | 11/2001 | Church et al. | 123/90.16 |
| 6,345,596 | B1 | * | 2/2002 | Kuhl | 123/90.16 |

OTHER PUBLICATIONS

Sandford, Malcolm H., et al., "Reduced Fuel Consumption & Emissions Through Cylinder Deactivation", *Aachener Kolloquium Fahrzeug—und Motorentechnik*, pp. 1017–1027 (1998).

* cited by examiner

DEACTIVATION ROLLER HYDRAULIC VALVE LIFTER

CROSS REFERENCE TO RELATED APPLICATIONS

This application is a continuation-in-part of U.S. patent application Ser. No. 09/693,452 filed Oct. 20, 2000.

TECHNICAL FIELD

The present invention relates to hydraulic valve lifters for use with internal combustion engines, and, more particularly, to a lifter-based device which accomplishes cylinder deactivation in push-rod engines.

BACKGROUND OF THE INVENTION

Cylinder deactivation is the deactivation of the intake and/or exhaust valves of a cylinder or cylinders during at least a portion of the combustion process, and is a proven method by which fuel economy can be improved. In effect, cylinder deactivation reduces the number of engine cylinders within which the combustion process is taking place. With fewer cylinders performing combustion, fuel efficiency is increased and the amount of pollutants emitted from the engine will be reduced. For example, in an eight-cylinder engine under certain operating conditions, four of the eight cylinders can be deactivated. Thus, combustion would be taking place in only four, rather than in all eight, cylinders. Cylinder deactivation is effective, for example, during part-load conditions when full engine power is not required for smooth and efficient engine operation. In vehicles having large displacement push rod engines, studies have shown that cylinder deactivation can improve fuel economy by as much as fifteen percent.

The reliability and performance of the large displacement push rod engines was proven early in the history of the automobile. The basic designs of the large displacement push rod engines in use today have remained virtually unchanged for a period of over thirty years, due in part to the popularity of such engines, the reluctance of the consumer to accept changes in engines, and the tremendous cost in designing, tooling, and testing such engines. Conventional methods of achieving cylinder deactivation, however, are not particularly suited to large displacement push rod engines. These conventional methods typically require the addition of components which do not fit within the space occupied by existing valve train components. Thus, the conventional methods of achieving cylinder deactivation typically necessitate major design changes in such engines.

Therefore, what is needed in the art is a device which enables cylinder deactivation in large displacement push rod engines.

Furthermore, what is needed in the art is a device which enables cylinder deactivation in large displacement push rod engines and is designed to fit within existing space occupied by conventional drive train components, thereby avoiding the need to redesign such engines.

Moreover, what is needed in the art is a device which enables cylinder deactivation in large displacement push rod engines without sacrificing the size of the hydraulic element.

SUMMARY OF THE INVENTION

The present invention provides a deactivation hydraulic valve lifter for use with push rod internal combustion engines. The lifter can be selectively deactivated such that a valve associated with the lifter is not operated, thereby selectively deactivating the engine cylinder.

The invention comprises, in one form thereof, a deactivation hydraulic valve lifter including an elongate lifter body having a substantially cylindrical inner wall. The inner wall defines at least one annular pin chamber therein. The lifter body has a lower end configured for engaging a cam of an engine. An elongate pin housing includes a substantially cylindrical pin housing wall and pin housing bottom. The pin housing wall includes an inner surface and an outer surface. A radially directed pin bore extends through the pin housing bottom. The pin housing is concentrically disposed within the inner wall of the lifter body such that the outer surface of the pin housing wall is adjacent to at least a portion of the inner wall of the lifter body. A plunger having a substantially cylindrical plunger wall with an inner surface and an outer surface is concentrically disposed within the pin housing such that the outer surface of the plunger wall is adjacent to at least a portion of the inner surface of the pin housing wall. A deactivation pin assembly is disposed within the pin bore and includes two pin members. The pin members are biased radially outward relative to each other. A portion of each pin member is disposed within the annular pin chamber to thereby couple the lifter body to the pin housing. The pin members are configured for moving toward each other when the pin chamber is pressurized, thereby retracting the pin members from within the annular pin chamber and decoupling the lifter body from the pin housing.

An advantage of the present invention is that it is received within standard-sized engine bores which accommodate conventional hydraulic valve lifters.

Another advantage of the present invention is that the deactivation pin assembly includes two pin members, thereby increasing the rigidity, strength, and operating range of the deactivation hydraulic valve lifter.

Yet another advantage of the present invention is that no orientation of the pin housing relative to the lifter body is required.

A still further advantage of the present invention is that the pin housing is free to rotate relative to the lifter body, thereby evenly distributing wear on the annular pin chamber.

An even further advantage of the present invention is that an external lost motion spring permits the use of a larger sized hydraulic element and operation under higher engine oil pressure.

Lastly, an advantage of the present invention is that lash can be robustly and accurately set to compensate for manufacturing tolerances.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENT

Figure 1:
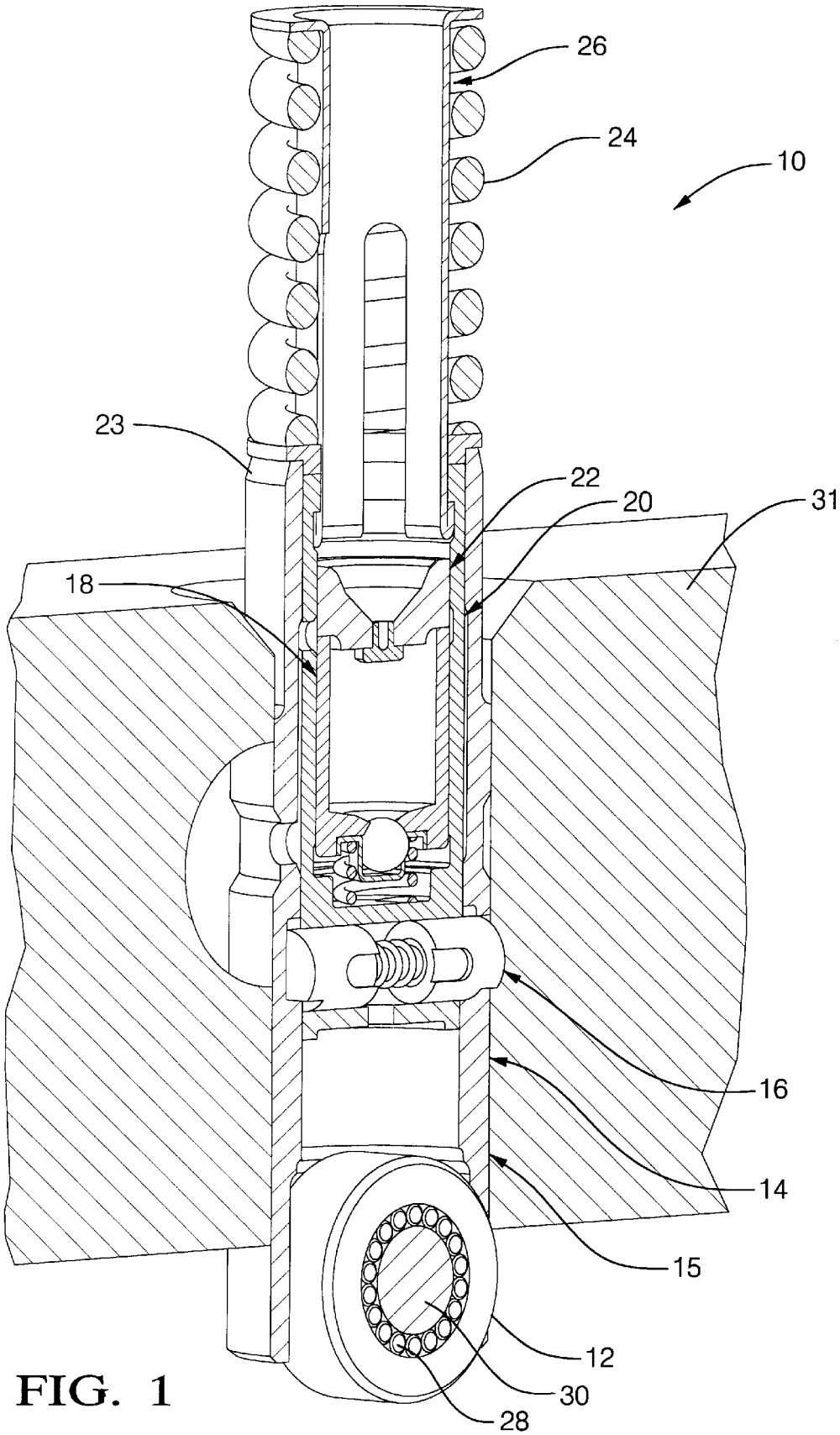
FIG. 1 is a partially sectioned, perspective view of one embodiment of the deactivation roller hydraulic valve lifter of the present invention.

Referring now to the drawings and particularly to FIG. 1, there is shown one embodiment of a deactivation roller hydraulic valve lifter 10 of the present invention. Deactivation roller hydraulic valve lifter (DRHVL) 10 includes roller 12, lifter body 14, deactivation pin assembly 16, plunger assembly 18, pin housing 20, pushrod seat assembly 22, spring seat 23, lost motion spring 24, and spring tower 26.

As will be more particularly described hereinafter, plunger assembly 18 is disposed concentrically within pin housing 20, which, in turn, is disposed concentrically within lifter body 14. Pushrod seat assembly 22 is disposed concentrically within pin housing 20 above plunger assembly 18. Roller 12 is associated with lifter body 14. Roller 12 rides on the cam of an internal combustion engine and is displaced vertically thereby. Roller 12 translates the rotary motion of the cam to vertical motion of lifter body 14. Deactivation pin assembly 16 normally engages lifter body 14, thereby transferring the vertical reciprocation of lifter body 14 to pin housing 20 and, in turn, to plunger assembly 18 and pushrod seat assembly 22. In this engaged position, the vertical reciprocation of DRHVL 10 opens and closes a valve of the internal combustion engine. Deactivation pin assembly 16 disengages to decouple lifter body 14 from pin housing 20 and, in turn, decouples plunger assembly 18 and pin housing 20 from the vertical reciprocation of lifter body 14. Thus, when deactivation pin assembly 16 is in the disengaged position, only lifter body 14 undergoes vertical reciprocation.

Roller 12 is of conventional construction, having the shape of a hollow cylindrical member within which bearings 28 are disposed and retained. Roller 12 is disposed within a first end 15 of lifter body 14. Shaft 30 passes through roller 12 such that bearings 28 surround shaft 30, and are disposed intermediate shaft 30 and the inside surface of roller 12. Shaft 30 is attached by, for example, staking to lifter body 14. Lifter body 14 includes on its outside surface anti-rotation flats (not shown) which are aligned with anti-rotation flats on an interior surface of a conventional anti-rotation guide (not shown) within which lifter body 14 of DRHVL 10 is inserted. This assembly is placed in the lifter bore of push-rod type engine 31. Roller 12 rides on the cam (not shown) of push-rod type engine 31. Roller 12 is constructed of, for example, hardened or hardenable steel or ceramic material.

Figure 2A:
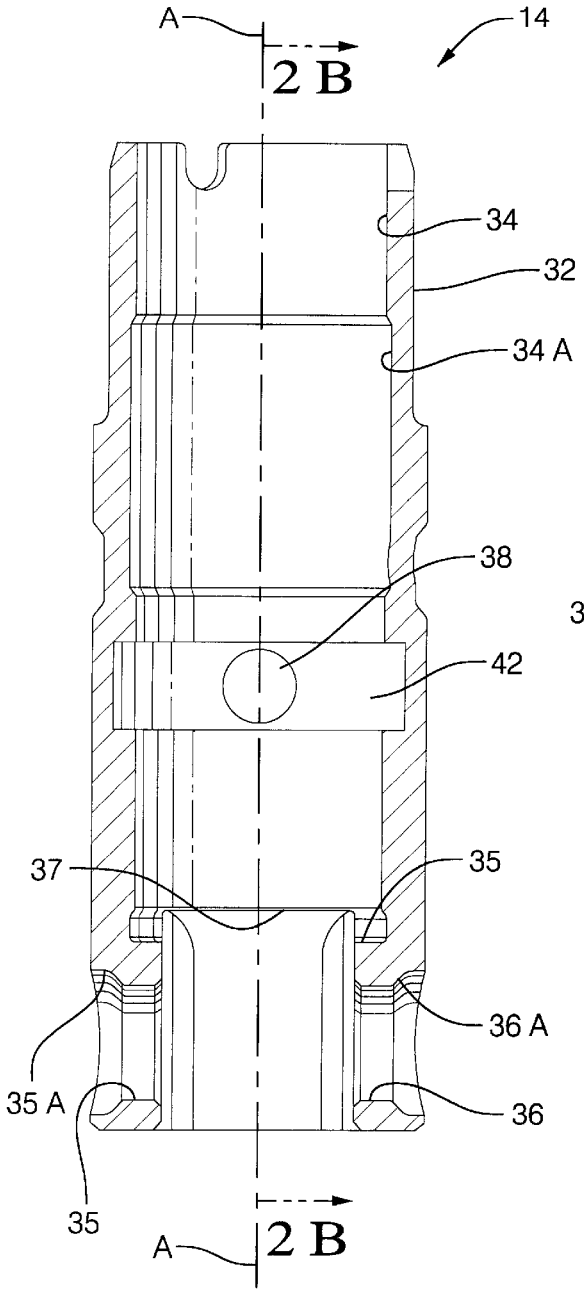
FIG. 2A is an axially-sectioned view of the lifter body of claim 1.
Figure 2B:
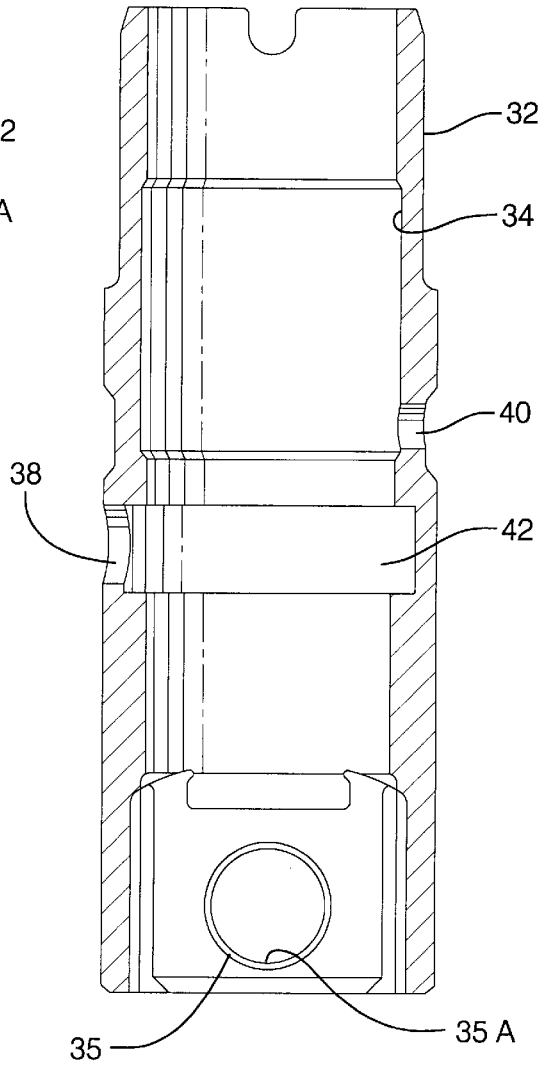
FIG. 2B is an axially-sectioned view of the lifter body of claim 1 rotated by 90 degrees.

Referring now to FIGS. 2*a* and 2*b*, lifter body 14 is an elongate cylindrical member dimensioned to be received within the space occupied by a standard roller hydraulic valve lifter. For example, lifter body 14 has a diameter of approximately 0.842 inches. Lifter body 14 has central axis A and includes cylindrical wall 32 having an inner surface 34. Inner surface 34 includes circumferential oil supply recess 34*a*. Diametrically opposed shaft orifices 35 and 36 are defined in cylindrical wall 32 and include rim portions 35*a* and 36*a*, respectively. Rim portions 35*a* and 36*a* have a diameter that is slightly greater than the diameter of shaft orifices 35 and 36, respectively. Shaft 30 passes through shaft orifice 35, extends diametrically through roller 12, and at least partially into shaft orifice 36. One end of shaft 30 is disposed in rim portion 35*a* and the other end of shaft 30 is disposed within rim portion 36*a*. The slightly larger diameter of rim portions 35*a* and 36*a* relative to shaft orifices 35 and 36 enables shaft 30 to be attached, such as, for example, by staking to lifter body 14. Cylindrical wall 32 defines roller pocket 37 intermediate shaft orifices 35 and 36, which receives roller 12.

Cylindrical wall 32 defines control port 38 and oil port 40. Inner surface 34 of cylindrical wall 32 defines annular pin chamber 42 therein. Preferably, annular pin chamber 42 is a contiguous chamber of a predetermined axial height, and extends around the entire circumference of inner surface 34 of cylindrical wall 32. Control port 38 is defined by an opening that extends through cylindrical wall 32, terminating at and opening into annular pin chamber 42. Thus, control port 38 provides a fluid passageway through cylindrical wall 32 and into annular pin chamber 42. Pressurized oil is injected through control port 38 into annular pin chamber 42 in order to retract deactivation pin assembly 16 from within annular pin chamber 42. Oil port 40 passes through cylindrical wall 32 and into oil supply recess 34*a*, thereby providing a passageway for lubricating oil to enter the interior of lifter body 14. Lifter body 14 is constructed of, for example, hardened or hardenable steel.

Figure 3:
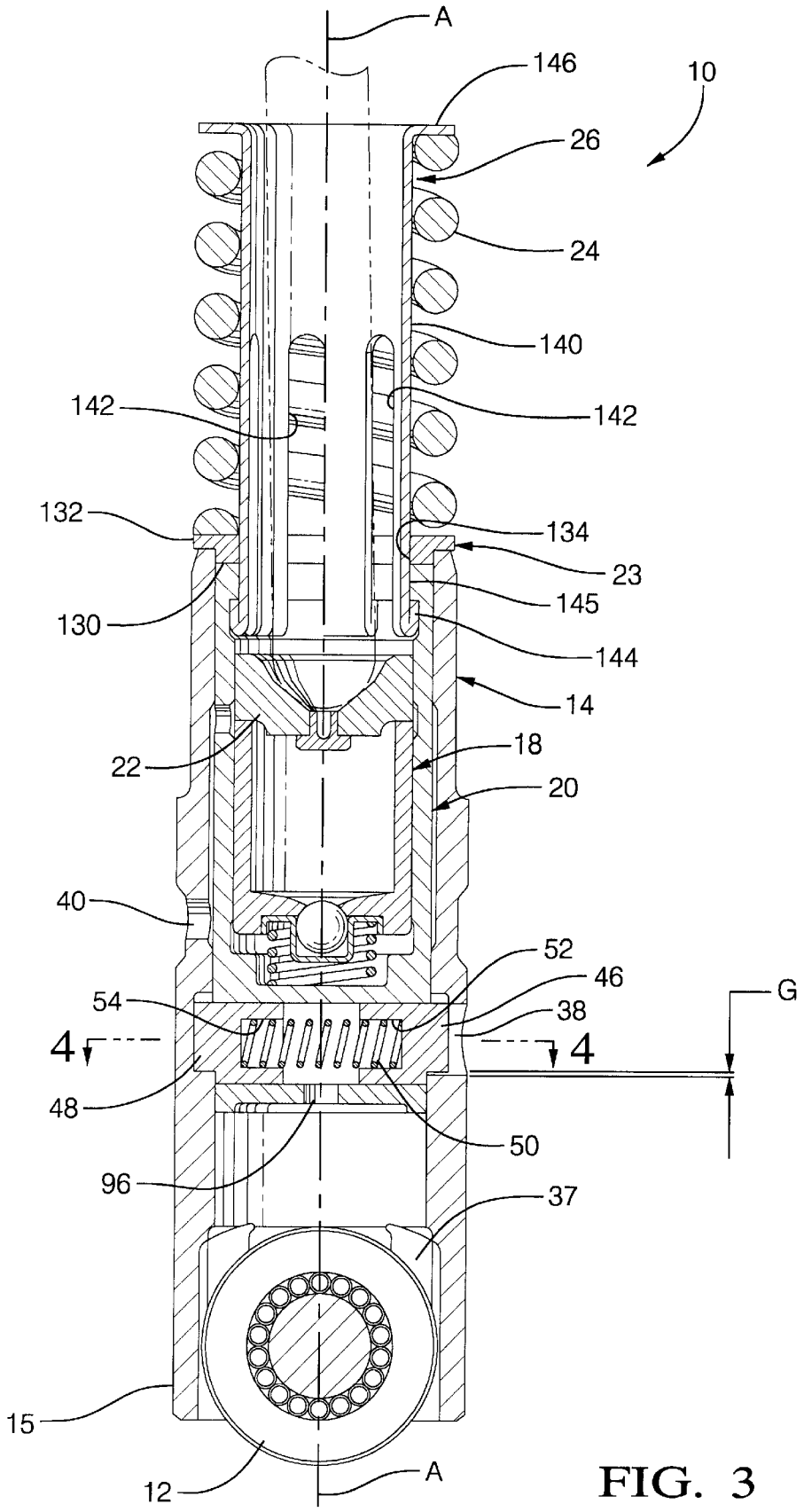
FIG. 3 is an axially-sectioned view of FIG. 1.
Figure 4:
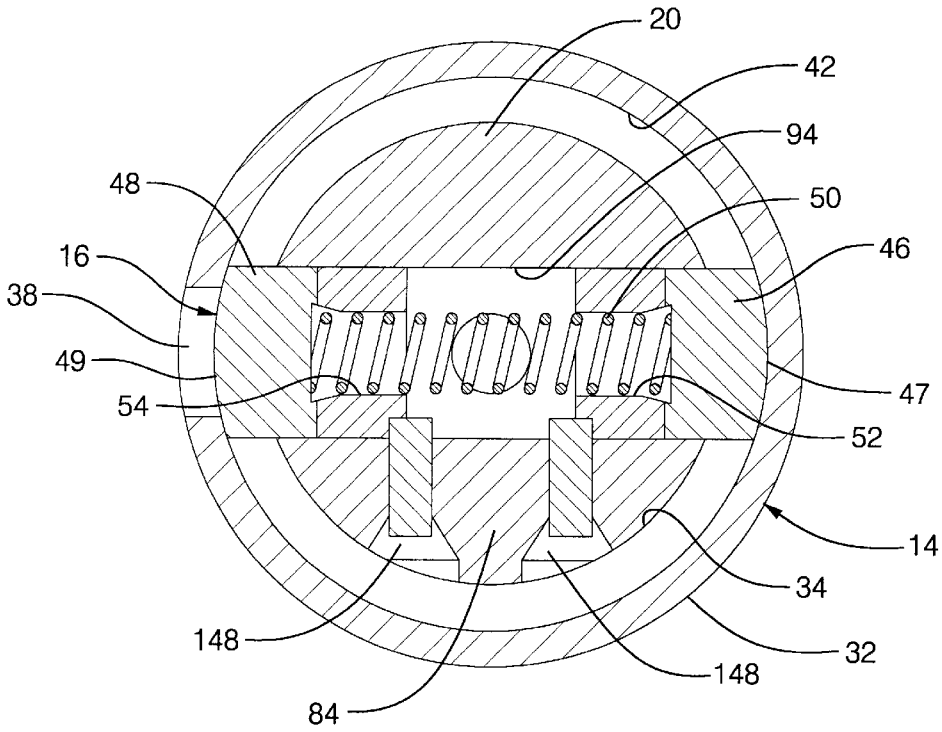
FIG. 4 is a cross-sectional view of FIG. 3 taken along line 4—4.
Figure 5:
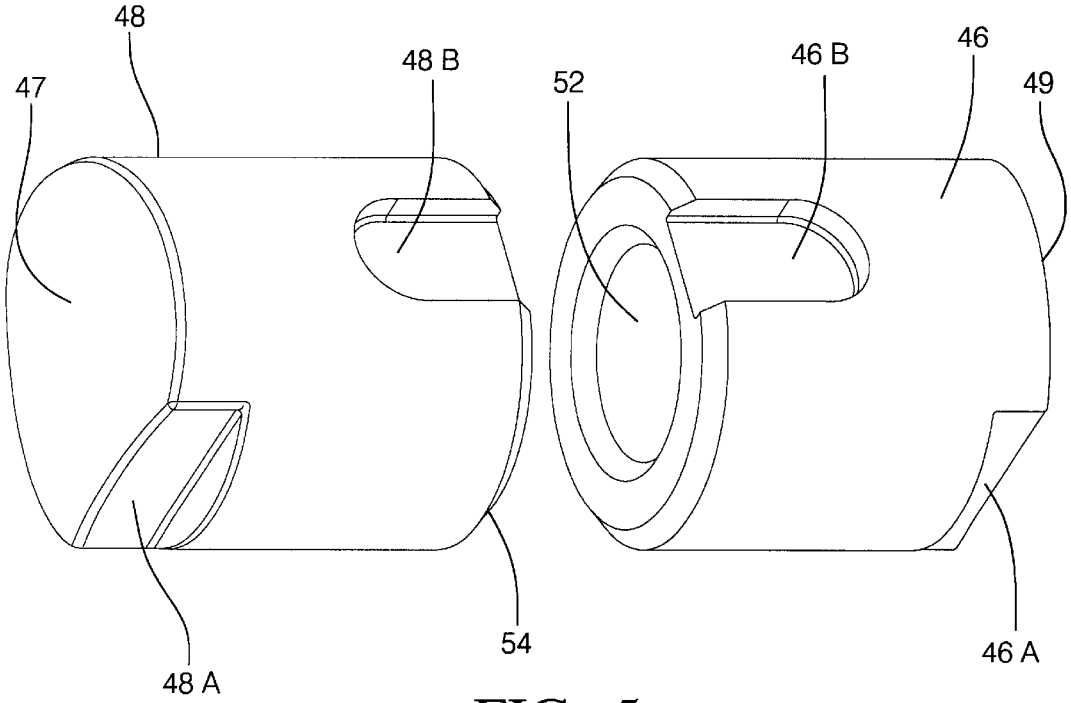
FIG. 5 is a perspective view of the pin members of FIG. 1.

As best shown in FIGS. 3 and 4, deactivation pin assembly 16 includes two pin members 46, 48 interconnected by and biased radially outward relative to lifter body 14 by pin spring 50. As shown in FIG. 5, each of pin members 46, 48 are round pins having stepped flats 46*a* and 48*a* which are dimensioned to be received within annular pin chamber 42. As will be described with more particularity hereinafter, a small gap G is provided between flats 46*a*, 48*a* and the lower edge of annular pin chamber 42. Gap G provides for clearance between flats 46*a* and 48*a* and the lower edge of annular pin chamber 42, thereby allowing for free movement of pin members 46 and 48 into pin chamber 42. Each of pin members 46 and 48 include at one end pin faces 47 and 49, respectively, and define pin bores 52 and 54, respectively, at each opposite end. Each of pin bores 52 and 54 receive a corresponding end of pin spring 50. In its normal or default position, pin members 46 and 48 of deactivation pin assembly 16 are biased radially outward by pin spring 50 such that at least a portion of each pin member 46 and 48 is disposed within annular pin chamber 42 of lifter body 14. Preferably, pin faces 47 and 49 have a radius of curvature that corresponds to but is a predetermined amount less than the curvature of inner surface 34 of cylindrical wall 32. Thus, line contact, rather than point contact, is provided between pin faces 47, 49 and the inner surface of pin chamber 42 upon initial engagement of pin members 46, 48 within pin chamber 42. Further, the slightly smaller curvature of pin faces 47, 49 provides a large active surface area against which the pressurized oil injected into annular pin chamber 42 acts to move pin members 46 and 48 radially toward each other to thereby retract pin members 46 and 48 from engagement within annular pin chamber 42. Each of pin members 46, 48 include stop grooves 46*b* and 48*b*, respectively. Stop grooves 46*b*, 48*b* extend a predetermined distance from the end of each pin member 46, 48 that is opposite pin faces 47, 49, respectively. Pin members 46 and 48 are constructed of, for example hardened or hardenable steel. Pin spring 50 is a coil spring constructed of, for example, music wire.

Figure 6:
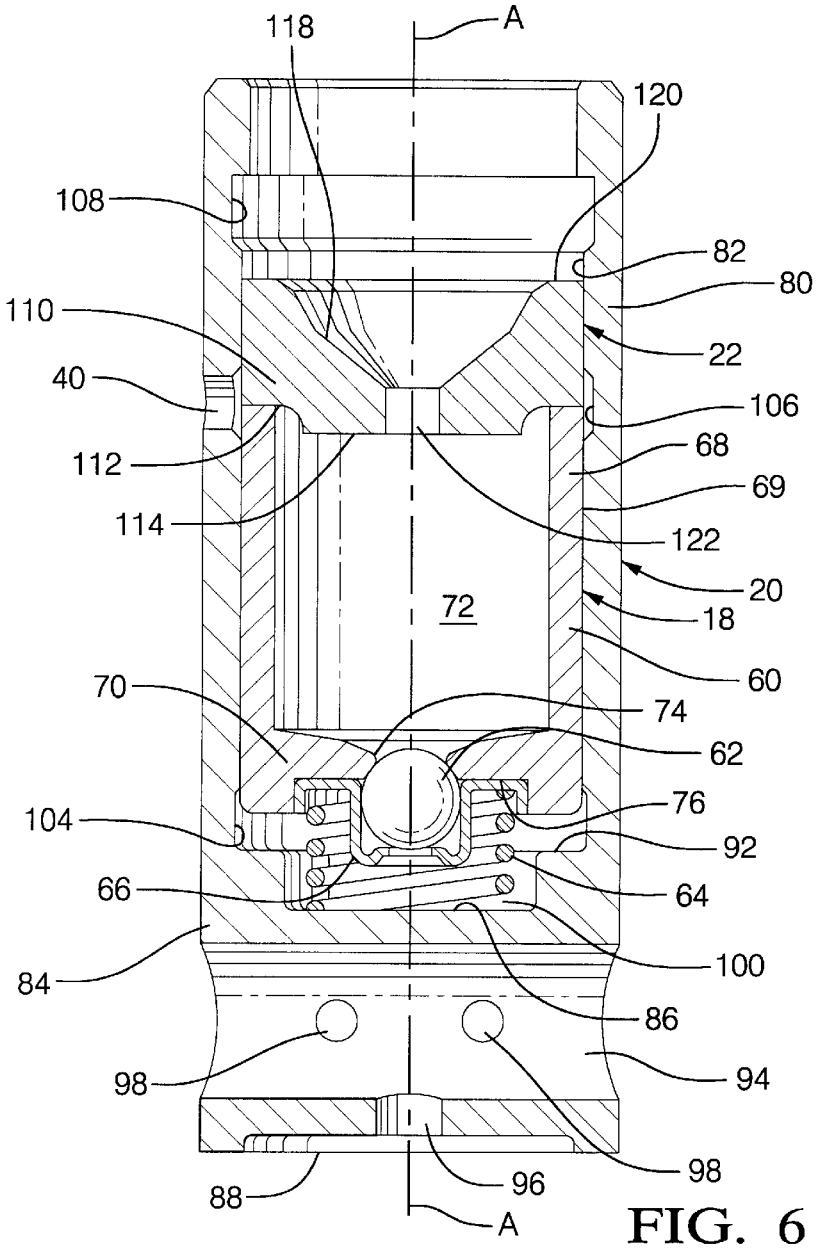
FIG. 6 is an axially-sectioned view of the pin housing, plunger assembly, and push rod seat of FIG. 1.

Referring now to FIG. 6, plunger assembly 18 is disposed within pin housing 20 which, in turn, is disposed within lifter body 14. Plunger assembly 18 includes plunger 60, plunger ball 62, plunger spring 64 and ball retainer 66. Plunger 60 is a cup shaped member including a cylindrical side wall 68 and a plunger bottom 70, and is slidably disposed concentrically within pin housing 20. Plunger side wall 68, bottom 70, and pushrod seat assembly 22 conjunctively define low-pressure chamber 72. Plunger bottom 70 includes plunger orifice 74 and seat 76. Plunger orifice 74 is circular in shape, having a predetermined diameter, and is concentric with plunger cylindrical side wall 68. Seat 76 is a recessed area defined by plunger bottom 70. Plunger 60 is constructed of, for example, hardenable or hardened steel. Plunger ball 62 is movably disposed within ball retainer 66, which, in turn, is disposed within seat 76 adjacent plunger bottom 70. Plunger spring 64 is a coil spring and is disposed between pin housing 20 and plunger assembly 18. More particularly, plunger spring 64 is disposed between seat 76 of plunger bottom 70 and pin housing 20, pressing ball retainer 66 against seat 76 of plunger bottom 70. In that position, plunger ball 62 and ball retainer 66 conjunctively define a ball-type check valve. Plunger ball 62 is a spherical ball of a predetermined circumference such that plunger ball 62 is movable within ball retainer 66 toward and away from plunger orifice 74, and seals plunger orifice 74 in a fluid tight manner. Plunger ball 62 is constructed of, for example, hardenable or hardened steel.

Pin housing 20 includes cylindrical side wall 80, having an inner surface 82, and bottom portion 84. Bottom portion 84 includes a bottom inner surface 86 and an outer surface 88. Bottom inner surface 86 is in the form of a cylindrical indentation which is surrounded by ledge 92. Bottom portion 84 defines a cylindrical deactivation pin bore 94 radially therethrough. Deactivation pin assembly 16 is disposed within deactivation pin bore 94. Drain aperture 96 is also defined by bottom portion 84 and extends from deactivation pin bore 94 through to outer surface 88 of bottom portion 84. Bottom 84 further defines two stop pin apertures 98 therein. Stop pin apertures 98 are parallel relative to each other and perpendicular relative to deactivation pin bore 94. Stop pin apertures 98 extend through side wall 80 radially inward through bottom 84, intersecting with and terminating in deactivation pin bore 94. Inner surface 82 of side wall 80 defines a lower annular groove 104 proximate to and extending a predetermined distance above ledge 92. Inner surface 82 also defines an intermediate annular groove 106 and an upper annular groove 108. Pin housing 20 is free to rotate relative to lifter body 14, and thus is not rotationally constrained within lifter body 14. Pin housing 20 is constructed of, for example, hardenable or hardened steel.

High pressure chamber 100 is conjunctively defined by bottom inner surface 86 of pin housing 20, plunger bottom 70, and the portion of inner surface 82 of cylindrical side wall 80 disposed therebetween. Plunger orifice 74 provides a passageway for the flow of fluid, such as, for example, oil, between high pressure chamber 100 and low pressure chamber 72. The ball-type check valve formed by plunger ball 62 and ball retainer 66 selectively controls the ability of the fluid to flow through plunger orifice 74.

Figure 7:
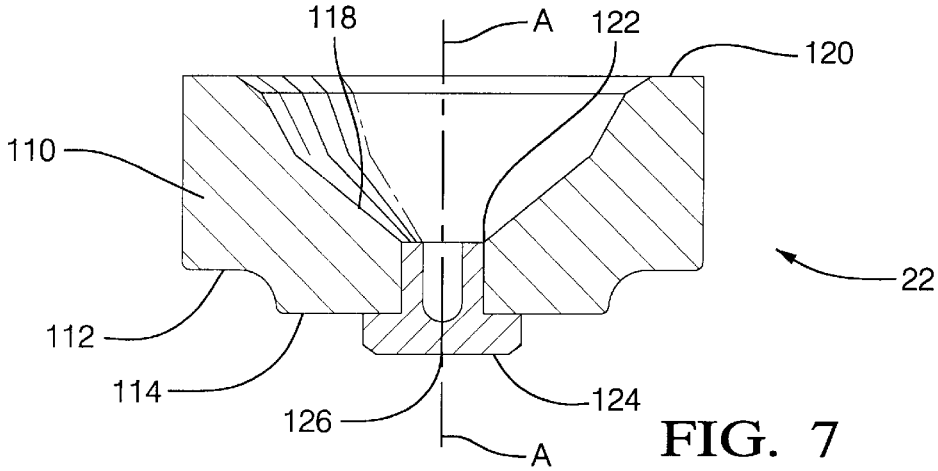
FIG. 7 is an axially-sectioned view of the push rod seat of FIG. 1.

Referring now to FIG. 7, pushrod seat assembly 22 includes cylindrical plug body 110 having a bottom surface 112 with a circumferential seat ring 114. Opposite bottom surface 112 is a bowl shaped socket 118 surrounded by shelf 120. Pushrod seat assembly 22 is disposed concentrically within pin housing 20 such that bottom surface 112 is adjacent to the top of side wall 68 of plunger 60. Plug body 110 defines pushrod seat orifice 122, which is concentric with plug body 110 and extends axially from bottom surface 112 through to socket 118. Insert 124 is inserted, such as, for example, by pressing, into pushrod seat orifice 122. Insert 124 carries an insert orifice 126 having a very small diameter of, for example, about 0.1 to 0.4 mm. Insert 124 is disposed within pushrod seat orifice 122 such that pushrod seat orifice 122 and insert orifice 126 are concentric and in fluid communication with each other. Pushrod seat 22 and insert 124 are constructed of, for example, hardenable or hardened steel.

Spring seat 23, as best shown in FIG. 3, is a ring-shaped member, having collar 130, flange 132, and orifice 134. Collar 130 is disposed concentrically within lifter body 14 and adjacent to the top edge of side wall 80 of pin housing 20. Flange 132 extends radially from collar 130 such that flange 132 overlaps onto the top edge of cylindrical wall 32 of lifter body 14. The height of gap G is determined by the dimensions of spring seat 23. More particularly, the length of the axial extension of collar 130 into lifter body 14 determines the axial position of pin housing 20 relative to lifter body 14, thereby determining the height of gap G.

Lost motion spring 24, as best shown in FIG. 3, is a coil spring having one end associated with spring seat 23 and the other end associated with spring tower 26. Lost motion spring 24 has a predetermined installed load which is selected to prevent hydraulic element pump up due to oil pressure in high pressure chamber 100 and due to the force exerted by plunger spring 64. Lost motion spring 24 is constructed of, for example, hardenable or hardened steel.

Spring tower 26, as best shown in FIG. 3, is an elongate cylindrical member having an outer wall 140. A plurality of slots 142 are defined in outer wall 140. Tabs 144 are formed along the bottom end of outer wall 140. A portion of outer wall 140 is concentrically disposed within pin housing 20, adjacent to inner surface 82 of side wall 80. Slots 142 enable spring tower 26 to be flexible enough to be pushed downward into pin housing 20 until each of tabs 144 are received within and snap into or engage upper annular groove 108 formed in side wall 80 of pin housing 20. Spring tower 26 defines at its top end tower collar 146, which is associated with the top end of lost motion spring 26. The lower end of spring tower 26, disposed within pin housing 20, acts to limit the extended height of pushrod seat assembly 22.

Stop pins 148, as best shown in FIG. 4, are, for example, pressed into stop pin apertures 98, and extend a predetermined distance into deactivation pin bore 94 of pin housing 20. Stop pins 148 are configured for restricting the inward retraction of pin members 46 and 48 of deactivation pin assembly 16. A respective end of each stop pin 148 is disposed within a corresponding one of stop grooves 46*b* and 48*b* of pin members 46, 48, thereby preventing the undesirable condition of pin shuttle. Generally, pin shuttle occurs when a deactivation pin or pin member is radially displaced or pushed to one side or the other of a housing and is therefore unable to completely disengage from within an orifice or deactivation chamber. Further, stop pins 148 in conjunction with stop grooves 46*b,* 48*b* prevent excessive rotation of pin members 46, 48 relative to pin housing 20. Stop pins 148 are constructed of, for example, hardenable or hardened steel.

Figure 8:
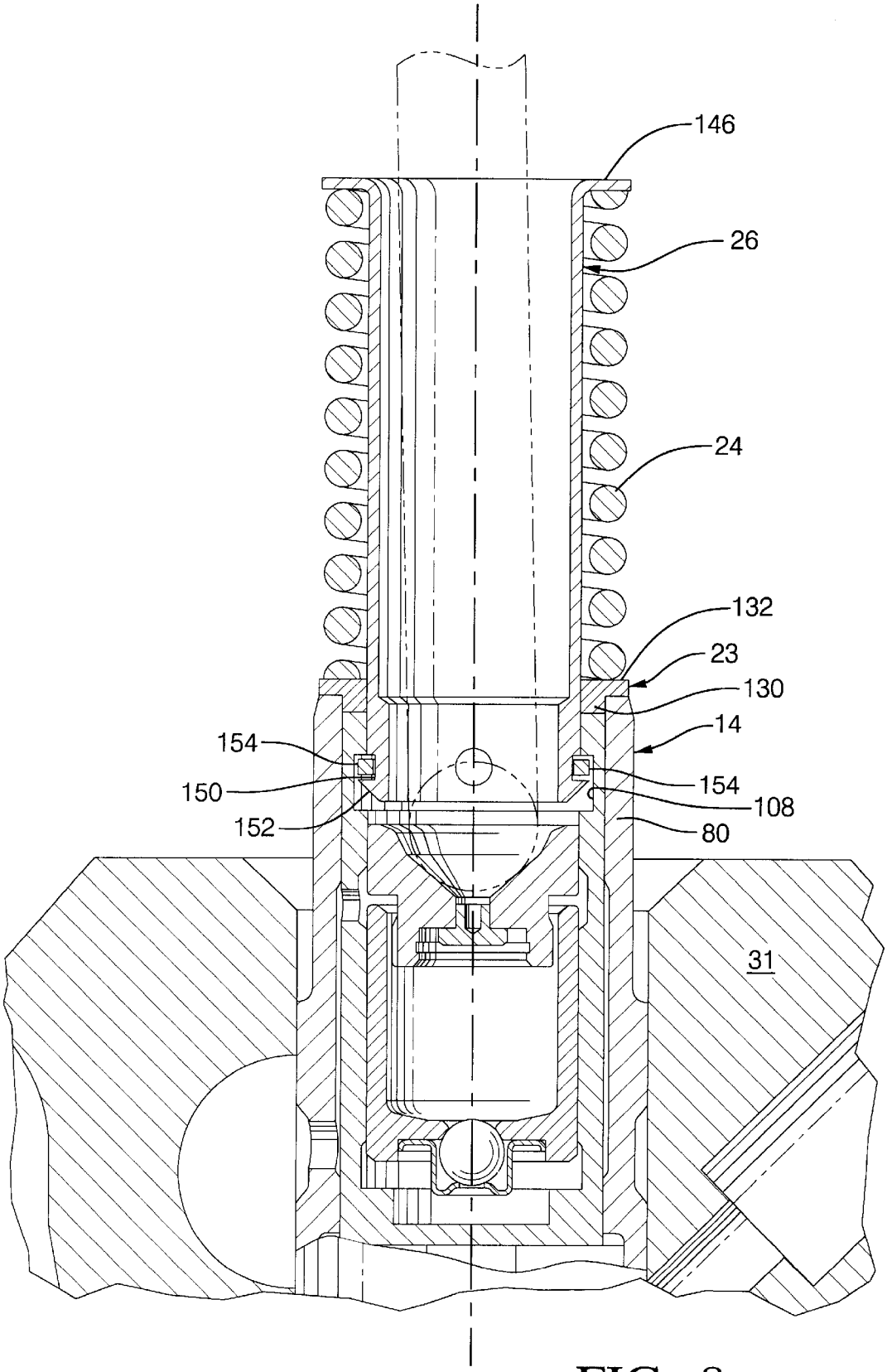
FIG. 8 is an axially-sectioned view of an alternate configuration of the deactivation roller hydraulic valve lifter of the present invention.

Spring tower 26 may be alternately configured, as shown in FIG. 8, to include a ring groove 150 and beveled bottom edge 152. In this embodiment, a resiliently deformable retaining ring 154 is disposed within upper annular groove 108 of pin housing 20. Retaining ring 154 is shown as a square or rectangular ring member, although it is to be understood that retaining ring 154 can be alternately configured, such as, for example, a round retaining ring. In order to assembly DRHVL 10, spring tower 26 is pushed downward into pin housing 20. As spring tower 26 is inserted into pin housing 20 and pushed axially downward, beveled bottom edge 152 of spring tower 26 contacts retaining ring 154 which is, in turn, displaced axially downward. This downward displacement of retaining ring 154 continues until retaining ring 154 contacts the bottom of upper annular groove 108, which prevents further downward movement of retaining ring 154. As downward motion of spring tower 26 continues, beveled edge 152 then acts to expand the resiliently deformable retaining ring 154. Thus, retaining ring 154 is resiliently expanded by beveled bottom edge 152 as spring tower 26 is pushed downward into pin housing 20. The expanded retaining ring 154 slides over spring tower 26 as spring tower 26 is pushed further downward into pin housing 20. When ring groove 150 and retaining ring 154 are in axial alignment, retaining ring 154 snaps into ring groove 150. As downward pressure upon spring tower 26 is removed, the action of lost motion spring 24 exerts an upward force on spring tower 26 until retaining ring 154 contacts the top edge of upper annular groove 108. Thus, retaining ring 154 retains a portion of spring tower 26 within pin housing 20, and determines the axial position of spring tower 26 relative to pin housing 20. Spring tower 26 is constructed of, for example, hardenable or hardened steel.

In use, roller 12 is associated with and rides on a lobe of an engine cam (not shown) in a conventional manner. Shaft 30 is attached within shaft orifices 35, 36, such as, for example, by staking, to lifter body 14. Thus, as the engine cam rotates, roller 12 follows the profile of an associated cam lobe and shaft 30 translate the rotary motion of the cam and cam lobe to linear, or vertical, motion of lifter body 14. When deactivation pin assembly 16 is in its normal operating or default position, pin members 46 and 48 are biased radially outward by pin spring 50. In this default position, pin members 46 and 48 extend radially outward from within deactivation pin bore 94 and at least partially into diametrically opposed locations within annular pin chamber 42. Deactivation pin assembly 16 is configured such that pin members 46 and 48 are biased radially outward to engage annular pin chamber 42 at diametrically opposed points. Annular pin chamber 42 is filled with fluid at all times during use, the fluid being at a low pressure when deactivation pin assembly 16 is in the normal or default position.

The use of two pin members results in a substantially rigid, strong, and durable assembly which can be used at higher engine speeds, or at higher engine revolutions per minute, than an assembly having one pin or non-diametrically opposed pins. The configuration of pin members 46 and 48 as round pin members with stepped flats 46*a,* 48*a,* respectively, increases the strength of the pin members and lowers the contact stress at the interface of pin members 46 and 48 and annular pin chamber 42. Annular pin chamber 42 is configured as a contiguous circumferential pin chamber. Thus, fixing the orientation of pin housing 20 relative to lifter body 14 is not necessary in order to ensure pin members 46 and 48 will be radially aligned with contiguous annular pin chamber 42. Pin members 46 and 48 rotate with pin housing 20 and will therefore randomly engage annular pin chamber 42 at various points along the circumference of lifter body 14. Thus, the rotation of pin housing 20 relative to lifter body 14 distributes the wear incurred by annular pin chamber 42 being repeatedly engaged and disengaged by pin members 46 and 48.

With pin members 46 and 48 engaged within annular pin chamber 42 of lifter body 14, vertical movement of lifter body 14 will result in vertical movement of pin housing 20, plunger assembly 18, and pushrod seat assembly 22. Thus, lifter body 14, plunger assembly 18, pin housing 20, and pushrod seat assembly 22 are reciprocated as substantially one body when deactivation pin assembly 16 is in its default position. With pin members 46 and 48 thus engaged, a push rod (not shown) seated in pushrod seat assembly 22 will likewise undergo reciprocal vertical motion. Through valve train linkage (not shown) the reciprocal motion of a push rod associated with pushrod seat assembly 22 will act to open and close a corresponding valve (not shown) of engine 31. Fluid, such as, for example oil or hydraulic fluid, at a relatively low pressure fills annular pin chamber 42 while pin members 46, 48 are engaged within annular pin chamber 42.

Deactivation pin assembly 16 is taken out of its default position and placed into a deactivated state by the injection of a pressurized fluid, such as, for example oil or hydraulic fluid, through control port 38. The injection of the pressurized fluid is selectively controlled by, for example, a control valve (not shown) or other suitable flow control device. The pressurized fluid is injected through control port 38 and into annular pin chamber 42 at a relatively high pressure to disengage the pin members 46, 48 from within annular pin chamber 42. Close tolerances between side wall 80 of pin housing 20 and inner surface 34 of cylindrical wall 32 of lifter body 14 act to retain the pressurized fluid within annular pin chamber 42, thus providing a chamber within which the pressurized fluid flows. The pressurized fluid fills annular pin chamber 42 and exerts pressure on pin faces 47, 49. The pressure forces pin members 46 and 48 radially inward, thereby compressing pin spring 50. Pin members 46 and 48 are thus retracted from within annular pin chamber 42 and into deactivation pin bore 94. The radially-inward movement of pin members 46 and 48 is limited by stop pins 148 which ride within stop grooves 46*b,* 48*b*.

Pin members 46 and 48 are configured with pin faces 47, 49 having a radius of curvature which matches the radius of curvature of inner surface 34, thereby providing a large active surface area against which the pressurized oil injected into annular pin chamber 42 acts to retract pin members 46 and 48 from within annular pin chamber 42. Pin members 46 and 48 are sized to be in close tolerance with deactivation pin bore 94. However, some of the pressurized fluid injected into annular pin chamber 42 may push into the area of deactivation pin bore 94 between pin members 46 and 48. If the area of deactivation pin bore 94 between pin members 46 and 48 were to fill with fluid, retraction of pin members 46 and 48 would become virtually impossible and a lock-up condition can result. Drain aperture 96 in pin housing 20 allows any of the fluid injected into annular pin chamber 42 which leaks into deactivation pin bore 94 to drain from within pin bore 94, thereby preventing a lock-up condition of pin members 46 and 48. Further, drain aperture 96 is preferably oriented in the direction of reciprocation of DRHVL 10 to take advantage of the reciprocation of DRHVL 10 to promote the drainage of fluid therethrough and, thereby, the removal of any fluid which has penetrated into deactivation pin bore 94.

With pin members 46 and 48 retracted from annular pin chamber 42, the vertical displacement of lifter body 14 through the operation of roller 12 is no longer transferred through pin members 46 and 48 to pin housing 20. Thus, pin housing 20, plunger assembly 18 and pushrod seat assembly 22 no longer move in conjunction with lifter body 14 when deactivation pin assembly 16 is in its deactivated state. Only lifter body 14 will be vertically displaced by the operation of the cam. Therefore, a push rod (not shown) seated in pushrod seat assembly 22 will not undergo reciprocal vertical motion, and will not operate its corresponding valve.

In the deactivated state, as lifter body 14 is vertically displaced by the engine cam lobe, lost motion spring 24 is compressed. As the cam lobe returns to its lowest lift profile, lost motion spring 24 expands and exerts, through spring seat 23, a downward force on lifter body 14 until flange 132 and collar 130 simultaneously contact lifter body 14 and pin housing 20, respectively. Any lift loss that occurs due to leakdown is recovered through the expanding action of plunger spring 64. Thus, the lash remaining in DRHVL 10 is limited to the gap G which is precisely set through the dimensions of spring seat 23. Excessive lash will accelerate wear of valve train components. Thus, where excessive lash exists, the interfacing components are pounded together as they are reciprocated by the cam. The pounding significantly increases wear and tear of the components, and possibly premature lifter or valve train failure. As will be described in more detail hereinafter, spring seat 23 sets an appropriate amount of lash, thereby preventing excessive wear and premature valve train failure. The dimensions of spring seat 23 are precisely controlled during manufacture. Thus, gap G and the amount of lash incorporated into DRHVL 10 are precisely controlled.

Lost motion spring 24 prevents separation between DRHVL 10 and the engine cam in the in the deactivated or disengaged state. Further, lost motion spring 24 resists the expansion of DRHVL 10 when the cam is at its lowest lift profile position. The tendency of DRHVL 10 to expand is due to the force exerted by plunger spring 64 and oil pressure within high pressure chamber 100 acting upon plunger 60. These forces tend to displace pin housing 20 downward toward roller 12, thereby reducing gap G. Thus, the oil pressure within high pressure chamber 100 and the force exerted by plunger spring 64 will expand, or pump-up, DRHVL 10 by displacing pin housing 20 downward toward roller 12. Spring tower 26 is firmly engaged with pin housing 20, and thus any downward movement of or force upon pin housing 20 will be transferred to spring tower 26. Thus, a compressive force, or a force in a direction toward roller 12, is exerted upon lost motion spring 24 via the downward force or movement of pin housing 20 which is transferred to spring tower 26. The pre-load or installed load of lost motion spring 24 is selected to resist the tendency of DRHVL 10 to pump-up or expand. If expansion is not resisted or limited by the installed load of lost motion spring 24, gap G will be reduced as pin housing 20 is displaced downward relative to pin chamber 42. Such unrestrained expansion and downward displacement of pin housing 20 may potentially adversely affect the ability of locking pin members 46, 48 to engage within pin chamber 42. If lost motion spring 24 is inadequately sized, gap G could be reduced an amount sufficient to prohibit the engagement of locking pins 46, 48 within pin chamber 42. Thus, lost motion spring 24 must be selected to resist the compressive forces exerted thereon due to the hydraulic element, operating oil pressure, and plunger spring.

Disposing lost motion spring 24 above lifter body 14, but within the plan envelope of DRHVL 10, provides increased space in which a larger lost motion spring 24 can be accommodated, which, in turn, enables the use in DRHVL 10 of a larger hydraulic element, higher operating oil pressure, and stronger plunger spring. Further, disposing lost motion spring 24 within the plan envelope of DRHVL 10 permits the insertion of DRHVL 10 into a standard-sized lifter anti-rotation guide. Spring tower 26 is, in effect, a reduced-diameter extension of pin housing 20. The diameter of spring tower 26 is a predetermined amount less than the diameter of pin housing 20 such that lost motion spring 24 can be of sufficient size and yet remain within the plan envelope of lifter body 14. Thus, spring tower 26 enables lost motion spring 24 to be appropriately sized and remain within the plan envelope of DRHVL 10.

Spring seat 23 is disposed intermediate lifter body 14 and lost motion spring 24. Spring seat 23 determines the relative positions of lifter body 14 and pin housing 20. More particularly, the axial dimension, or length, of collar 130 determines the relative axial positions of lifter body 14 and pin housing 20. As show in FIG. 3, gap G exists between the bottom of annular pin chamber 42 and the bottom of pin faces 47, 49. By changing the axial dimension of collar 130 gap G can be precisely manipulated. For example, lengthening collar 130 places pin housing 20 axially lower relative to lifter body 14 thereby decreasing the height of gap G. By adjusting the axial dimension of collar 130, variations in manufacturing tolerances and variations in the dimensions of the component parts of DRHVL 10 can be accurately compensated for while a tight tolerance on gap G is accurately maintained. Flexibility in manufacture and assembly is accomplished by manufacturing a number of spring seats 23 having collars 130 of various predetermined axial dimensions. A particular spring seat 23 would be selected based upon the axial dimension of collar 130 in order to produce a DRHVL 10 having an appropriately-sized gap G.

Figure 9:
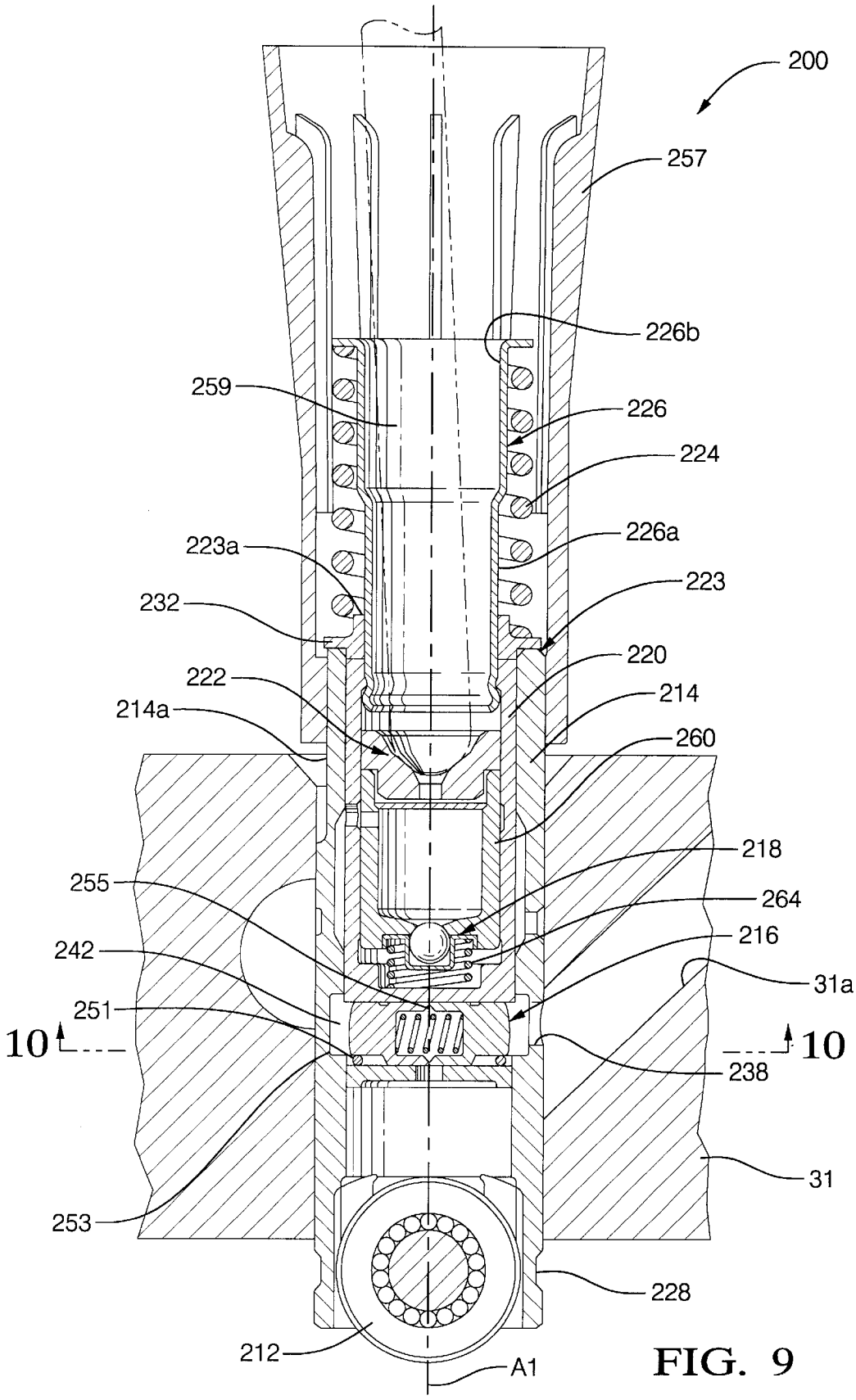
FIG. 9 is an axially-sectioned view of a second embodiment of the deactivation roller hydraulic valve lifter of the present invention.

Referring now to FIG. 9, a second embodiment of a deactivation roller hydraulic valve lifter of the present invention is shown. Deactivation roller hydraulic valve lifter (DRHVL) 200 has central axis A1, and includes roller 212, lifter body 214, deactivation pin assembly 216, plunger assembly 218, pin housing 220, pushrod seat assembly 222, spring seat 223, lost motion spring 224, and spring tower 226. DRHVL 200 is generally similar to DRHVL 10 in structure and operation, and thus only the distinctions between the two embodiments are set forth in detail below.

Lifter body 214 includes circumferential vent groove 228 disposed on the outside surface (not referenced) of lifter body 214 at the end thereof that is disposed proximate roller 212. In the embodiment shown, vent groove 228 has a lower edge (not referenced) that is spaced a predetermined distance from the end of lifter body 214 that is proximate roller 212. However, it is to be understood that vent groove 228 can be alternately configured, such as, for example, having no lower or bottom edge, but rather extending to and being contiguous with the end of lifter body 214 that is disposed proximate roller 212. Vent groove 228 is of a predetermined depth, such as, for example, approximately 0.10 mm to approximately 0.30 mm. Vent groove 228 can be of a greater depth, dependent in part upon the thickness and strength of the lifter body wall. Vent groove 228 extends around the circumference of the outside surface of lifter body 214. The outside surface of lifter body 214 also includes recessed areas or flats 214*a,* 214*b* (only one shown), which engage corresponding features in an anti-rotation guide as will be more particularly described hereinafter. The diameter of lifter body 214 when taken across one or both of flats 214*a,* 214*b* is reduced relative to a diameter that does not include flats 214*a,* 214*b.*

In use, lifter body 214 is reciprocated in a generally axial direction by rotary motion of a cam lobe (not shown) of a cam shaft (not shown) associated with DRHVL 200. As lifter body 214 is lifted, i.e., roller 212 is displaced in the direction toward hydraulic supply bore 31*a,* the force applied thereto by the cam lobe displaces lifter body 214 in a generally-radial direction within the lifter bore (not referenced) of engine 31 and away from hydraulic supply bore 31*a.* Thus, a small gap is created between lifter body 214 and the lifter bore of engine 31 during the lift event. Fluid, such as air, is drawn or flows into this gap when the pressure of the switching fluid is low, such as when lifter 200 is operating with deactivation pin assembly in the default position (i.e., engaged within annular pin chamber 242). As lifter body 214 falls, i.e. roller 212 is displaced in the direction toward the cam shaft, lifter body 214 is displaced in a generally-radial direction within the lifter bore of engine 31 and toward hydraulic supply bore 31*a.* At least some of the volume of air or other fluid that was drawn into the lifter bore of engine 31 during the lift event is trapped within the lifter bore and displaced into hydraulic supply bore 31*a,* where the air enters or mixes with the fluid therein. Thus, substantially higher fluid flow and time would be required in order to compress the fluid and disengage deactivation pin assembly 216. Such a condition renders the operation of deactivation pin assembly 216, i.e., the engagement and disengagement thereof with annular pin chamber 242, less reliable. Vent groove 228 reduces the amount of air that is trapped within the lifter bore and mixes with the fluid therein, and thereby improves the operational reliability of deactivation pin assembly 216.

Vent groove 228 is disposed outside of the lifter bore of engine 31 when the cam lobe associated with DRHVL 200 is at or near its low lift or zero lift position. At least a portion of vent groove 228 is disposed within the lifter bore of engine 31 during the lift event, such as, for example, when the cam lobe is within thirty degrees of its maximum lift position. As lifter body 214 falls and is displaced radially back toward hydraulic supply bore 31*a,* at least a portion of the trapped air enters and is trapped within vent groove 228. The air trapped in vent groove 228 is prevented from entering hydraulic supply bore 31*a.* Thus, the amount of air that is pushed into hydraulic supply bore 31*a* and mixed with the fluid therein is reduced. With less air entering the fluid, the increase in the amount of fluid and time required to compress the fluid and disengage deactivation pin assembly 216 are also reduced.

Figure 10A:
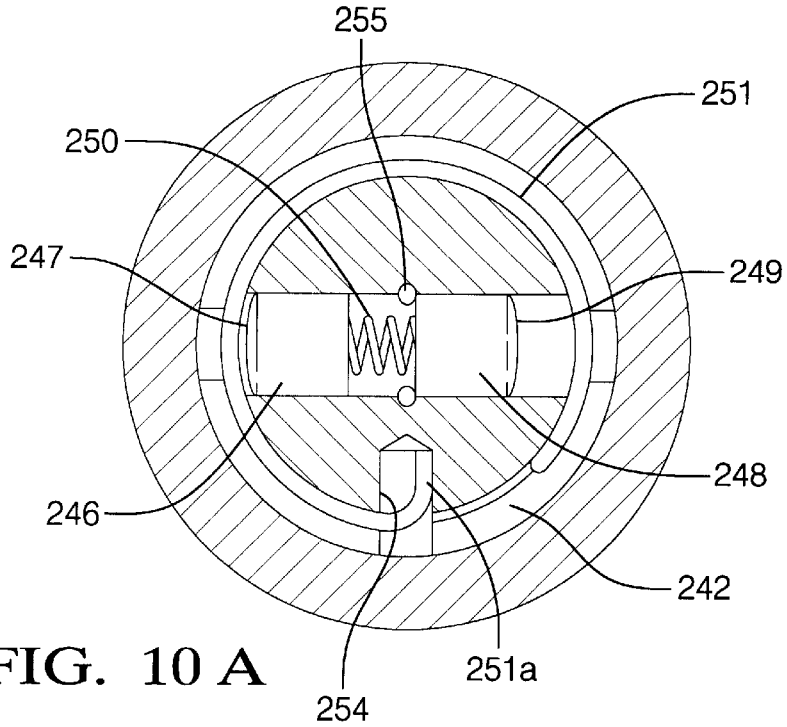
FIG. 10*a* is a cross-sectional view of FIG. 9.
Figure 10B:
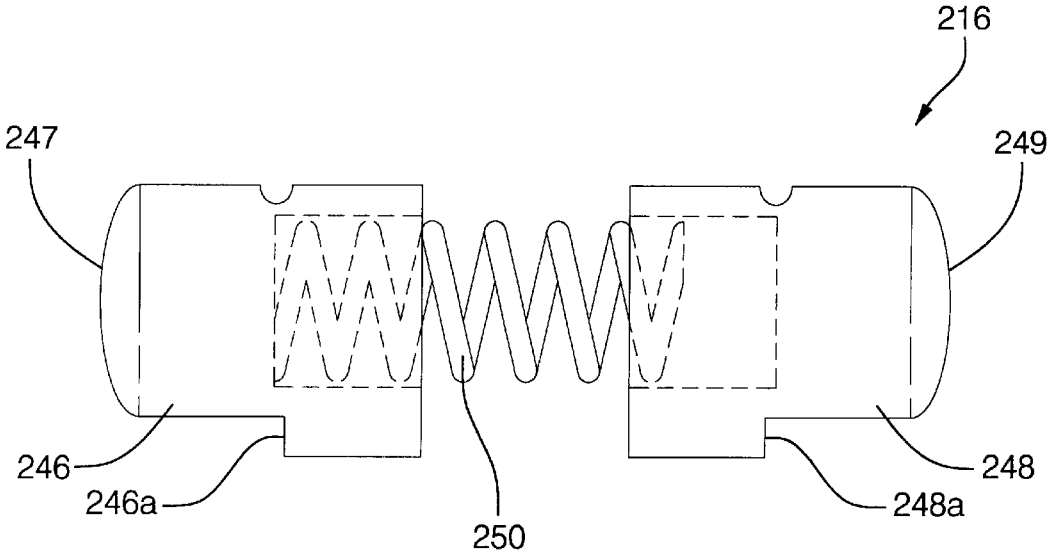
FIG. 10*b* is a perspective view of the deactivation pin assembly of FIG. 10*a*.

As best shown in FIGS. 10*a* and 10*b,* deactivation pin assembly 216 includes two pin members 246, 248 interconnected by and biased radially outward relative to lifter body 214 by pin spring 250. Each of pin members 246, 248 are substantially round pins having stepped flats 246*a* and 248*a* which are dimensioned to be received within annular pin chamber 242. Each of pin members 246, 248 have a diameter that is greater than the diameter of control port 238. Pin members 246 and 248 include at one end thereof pin faces 247 and 249, respectively. Pin faces 247 and 249 are substantially spherical in shape, and have a spherical radius that is greater than the radius of the axially-oriented surface of annular pin chamber 242.

The relatively-large spherical radius of pin faces 247, 249 relative to the axially-oriented surface of pin chamber 242 results in pin faces 247, 249 being flatter than the axially-oriented surface of pin chamber 242. Thus, only the outer edges of pin faces 247, 249 contact the axially-oriented surface of pin chamber 242. Pin members 246, 248 are thereby prevented from extending into and/or closely engaging and blocking control port 238. The relatively large spherical radius of pin faces 247, 249 also provides clearance between pin members 246, 248 and the transition between, or radius formed at the interface of, the axially-oriented surface and the radially-oriented surfaces of pin chamber 242. Thus, friction between and wear and tear of pin members 246, 248 and pin chamber 242 is reduced.

Deactivation pin assembly 216 further includes anti-rotation ring 251, which is disposed within circumferential groove 253 (FIG. 9) of pin housing 220 adjacent pin members 246, 248. Anti-rotation ring 251 is disposed in close proximity to stepped flats 246*a* and 248*a,* and thus substantially limits rotation of pin members 246, 248. Anti-rotation ring 251 is generally G-shaped and includes projection 251*a,* which is disposed in bore 254 of pin housing 220. Projection 251*a* thus orients anti-rotation ring 251 relative to pin housing 220 and relative to pin members 246, 248, thereby preventing the gap (not referenced) in anti-rotation ring 251 from aligning with either of pin members 246, 248 which would allow undesirable rotation of one of pin members 246, 248. Alternatively, circumferential groove 253 includes an orienting feature, such as, for example, a raised portion or discontinuity that engages the gap of anti-rotation ring 251 and thus orients anti-rotation ring 251 relative to pin members 246, 248.

Deactivation pin assembly 216 also includes stop ring 255, which limits the inward travel of pin members 246, 248, and is retained partially within a groove formed in pin housing 220. Thus, DRHVL 200 eliminates the need for the stop grooves 46*b,* 48*b* and stop pins 148 of DRHVL 10.

Spring seat 223 (FIG. 9) of DRHVL 200 includes upper lip 223*a* around which a first end of lost motion spring 224 is disposed. Upper lip 223*a* prevents excessive radial movement of lost motion spring 224 relative to central axis A1 during operation of DRHVL 200. Flange 232 extends slightly beyond the outside diameter of body 214 taken across flats 214*a* and 214*b,* such as, for example, by approximately 0.25 mm to approximately 0.75 mm, and retains DRHVL 200 within a corresponding anti-rotation guide 257 (FIG. 9). More particularly, DRHVL 200 is inserted and pushed firmly into anti-rotation guide 257. Upper lip 223*a* deflects the walls of anti-rotation guide 257 until upper lip 223*a* is disposed above ledge 257*a* of anti-rotation guide 257. Thus disposed, the portions of upper lip 223*a* disposed proximate flats 214*a,* 214*b* extends beyond the outer surface of lifter body 214 and engages or seats upon ledge 257*a,* thereby retaining DRHVL 200 within anti-rotation guide 257 prior to installation of DRHVL 200 and guide 257 into engine 31. DRHVL 200 is thus placed into a subassembly or pre-assembled together with anti-rotation guide 257 (i.e., kitted) for easy installation within engine 31.

It should be particularly noted that using upper lip 223*a* to retain DRHVL 200 within anti-rotation guide 257 substantially reduces friction between lifter body 214 and anti-rotation guide 257 relative to conventional methods of retaining lifters within anti-rotation guides. Conventionally, lifters are retained within anti-rotation guides by an interference or frictional fit between the lifter body and the anti-rotation guide. More particularly, the walls of the anti-rotation guide frictionally engage flats on the outside surface of the lifter body. The frictional force of the interference fit is sufficient to retain the lifter in the anti-rotation guide for subsequent handling and installation in an engine (i.e., kitting). A more detailed discussion of such a frictional interference fit kitting of a lifter and anti-rotation guide is provided in U.S. Pat. No. 5,088,455.

In contrast, DRHVL 200 is inserted into anti-rotation guide 257 until upper lip 223*a* of spring seat 223 seats on ledge 257*a* of anti-rotation guide 257. Thus, the engagement of ledge 257*a* by upper lip 223*a* retains DRHVL 200 within anti-rotation guide 257. The interface between anti-rotation guide 257 and lifter body 214 imposes substantially no frictional force that counteracts the operation of DRHVL 200, and thus has distinct advantages over the conventional methods of retaining a lifter within an anti-rotation guide as described above.

The size, and thus the spring force, of plunger springs used in DRHVLs are limited due to the reduced size of the hydraulic element in such lifters. Reducing friction between lifter body 214 and anti-rotation guide 257 enables plunger spring 264 to be of a smaller size and of a smaller spring force, while still being of sufficient size/force to recover leak down within DRHVL 200.

Generally, substantial or complete lifter leak down occurs when engine 31 is not operating, and in lifter that are engaged with or stopped upon a lifting portion of the profile of an associated cam lobe. The valve spring (not shown) of engine 31 pushes through pushrod 259 (shown in phantom in FIG. 9) and displaces plunger 260 axially downward, i.e., in the direction of roller 212, within and relative to pin housing 220 which, in turn, compresses plunger spring 264 and causes the high pressure chamber to leak down. When engine 31 is first started, and engine oil pressure is relatively low, the only force available to recover leak down and reestablish engagement of pin housing 220, lifter body 214 and roller 212 with the cam lobe is the force exerted by plunger spring 264. Any friction between lifter body 214 and anti-rotation guide 257 may be sufficient to counteract the expansion force exerted by plunger spring 264, and can result in undesirable lifter noise or clatter, especially when the frictional force approaches the force of plunger spring 264.

Ledge 257*a* is engaged by upper lip 232*a* to retain lifter body 214 within anti-rotation guide 257. Substantially no frictional force exists between lifter body 214 and anti-rotation guide 257. Thus, the force exerted against lifter body 214 by plunger spring 264 is not substantially counteracted by friction between lifter body 214 and anti-rotation guide 257. Therefore, substantially all of the force of plunger spring 264 is used to bring pin housing 220, lifter body 214 and roller 212 into engagement with the cam lobe of the engine camshaft. The adverse effects, i.e., lifter noise or clatter, of the constraints imposed upon the size and force of plunger spring 264 are therefore reduced.

Spring tower 226 of DRHVL 200 includes first portion 226*a* and second portion 226*b*. First portion 226*a* is of a smaller diameter relative to second portion 226*b*, and thus spring tower 226 has a stepped outside diameter. The increased diameter of second portion 226*b*, relative to the smaller diameter of spring tower 26 of DRHVL 10 and relative to the smaller diameter of first portion 226*a*, increases the angle through which pushrod 259 can pivot relative to central axis A1 without contacting second portion 226*b* of spring tower 226. Further, the increased diameter of second portion 226*b* enables the use of larger-diameter lost motion spring 224 having an increased spring force, thereby increasing the engine oil pressure limit under which DRHVL 200 is operable.

In the embodiments shown, lifter body 14 and 214 are sized to be received within a standard-sized anti-rotation guide or within a standard-sized lifter bore of a push-rod type internal combustion engine. However, it is to be understood that the lifter body may be alternately configured to have a greater or smaller size and/or diameter and therefore be received within variously sized lifter bores and/or anti-rotation guides.

In the embodiments shown, annular pin chamber 42 is disclosed as being configured as a contiguous annular pin chamber. However, it is to be understood that the annular pin chamber can be alternately configured, such as, for example, as two or more non-contiguous annular chambers configured to receive a corresponding one of deactivation pin members 46 and 48. In this configuration, each annular pin chamber includes a corresponding control port through which the pressurized fluid is injected to retract a respective pin member from within the corresponding annular pin chamber.

In the embodiments shown, pin members 46 and 48 are disclosed as round pin members having flats 46*a*, 48*a*, respectively. However, it is to be understood that the pin members can be alternately configured, such as, for example, square or oval pin members having respective flats, or may be configured without flats, and be received within a correspondingly configured pin chamber.

In the embodiments shown, plunger ball 62 and ball retainer 66 conjunctively define a ball-type check valve. However, it is to be understood that DRHVL 10 and DRHVL 200 may be alternately configured with, such as, for example, a plate-type check valve or any other suitable valve.

In the embodiments shown, deactivation pin assembly 16 and 216 each include two pin members 46, 48 and 246, 248, respectively. However, it is to be understood that deactivation pin assembly may include a single pin member or virtually any desired number of pin members.

In the embodiments shown, stop pins 148 are disposed within a respective one of stop pin apertures 98 and extend radially inward to intersect with one side wall of deactivation pin bore 94. However, it is to be understood that the stop pin apertures may extend radially inward from locations on opposite sides of pin housing 20 and intersect with opposite side walls of deactivation pin bore 94.

In the embodiments shown, insert 124 is inserted by, for example, pressing into pushrod seat orifice 122. However, it is to be understood that the insert can be alternately configured, such as, for example, otherwise attached to or formed integrally with the push rod seat. Furthermore, it is to be understood that the insert can be replaced by, for example, a conventional flat metering plate disposed in association with the crowned underside of the pushrod seat, as shown in FIG. 9.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A deactivation hydraulic valve lifter, comprising:

an elongate lifter body having a substantially cylindrical inner wall, said inner wall defining at least one annular pin chamber therein, said lifter body having a lower end configured for engaging a cam of an engine;

an elongate pin housing including a substantially cylindrical pin housing wall and pin housing bottom, said pin housing wall having an inner surface and an outer surface, said pin housing bottom defining a radially directed pin bore therethrough, said pin housing being substantially concentrically disposed within said inner wall of said lifter body such that said outer surface of said pin housing wall is adjacent to at least a portion of said inner wall of said lifter body, a plunger having a substantially cylindrical plunger wall, said plunger wall having an inner surface and an outer surface, said plunger being substantially concentrically disposed within said pin housing such that said outer surface of said plunger wall is adjacent to at least a portion of said inner surface of said pin housing wall;

a deactivation pin assembly disposed at least partially within said pin bore, said deactivation pin assembly including two pin members, said pin members biased radially outward relative to each other, at least a portion of each said pin member being disposed within a corresponding one of said at least one annular pin chamber to thereby couple said lifter body to said pin housing, said pin members being configured for moving toward each other when said at least one annular pin chamber is pressurized, thereby retracting said pin members from within a corresponding one of said at least one annular pin chamber and decoupling said lifter body from said pin housing; and a vent groove disposed on an outside surface of said lifter body, said vent grove being disposed proximate to and a predetermined distance from said lower end of said lifter body.

2. The deactivation hydraulic valve lifter of claim 1, further comprising:

an elongate spring tower including a substantially cylindrical tower wall, said tower wall having a first end and a flanged end, said spring tower being substantially concentrically disposed relative to said pin housing, said first end of said tower wall being coupled to said inner surface of said pin housing wall, said cylindrical tower wall extending axially from within said pin housing wall a predetermined distance above a top end of said lifter body; and a lost motion spring having a first end and a second end, said first end engaging said flanged end of said spring tower, said second end associated with said top end of said lifter body, said lost motion spring being compressed between said top end of said lifter body and said flanged end of said spring tower, said lost motion spring configured for exerting a force in a first axial direction upon said lifter body and in a second axial direction upon said spring tower, said first axial direction being opposite to said second axial direction.

3. The deactivation hydraulic valve lifter of claim 2, further comprising a spring seat, said spring seat including a substantially cylindrical flange portion and a substantially cylindrical lip portion, said lip portion extending in an axial direction from said flange portion in a direction toward said flanged end of said spring tower, a spring seat orifice defined by said spring seat, said flange portion being disposed on said upper end of said lifter body, said spring seat orifice surrounding a portion of an outer surface of said tower wall, said second end of said lost motion spring engaging said flange portion of said spring seat.

4. The deactivation hydraulic valve lifter of claim 3, wherein said flange portion has a diameter, said diameter being greater than an outside diameter of said lifter body taken across at least one flat disposed on an outside surface of said lifter body, said flange portion extending radially beyond the outside diameter of said lifter body at said at least one flat by a predetermined distance.

5. The deactivation hydraulic valve lifter of claim 2, wherein said first end of said spring tower has a first diameter, said flanged end of said spring tower having a second diameter, said first diameter being greater than said second diameter.

6. The deactivation hydraulic valve lifter of claim 1, wherein said vent groove comprises a groove extending contiguously around a circumference of said outside surface of said lifter body.

7. The deactivation hydraulic valve lifter of claim 1, wherein each said pin member includes a respective front surface and a respective rear surface, each said front surface being disposed radially outward of a corresponding rear surface relative to said pin housing, a pin spring interconnecting said rear surfaces of each said pin member, said pin spring biasing each said pin member radially outward relative to said pin housing such that each respective front surface is disposed within a corresponding one of said at least one annular pin chamber to thereby couple said lifter body to said pin housing.

8. The deactivation hydraulic valve lifter of claim 7, wherein each said pin member is substantially cylindrical.

9. The deactivation hydraulic valve lifter of claim 7, wherein each respective front surface is substantially spherical in shape.

* * * * *